United States Patent [19]

Krieger et al.

[11] Patent Number: 4,476,898

[45] Date of Patent: Oct. 16, 1984

[54] MINE-ROOF SUPPORT CONTROL MEANS

[75] Inventors: Karl Krieger, Wuppertal; Günther Kuschke, Castrop-Rauxel, both of Fed. Rep. of Germany

[73] Assignee: Hermann Hemscheidt Maschinenfabrik GmbH & Co., Wuppertal, Fed. Rep. of Germany

[21] Appl. No.: 359,940

[22] Filed: Mar. 19, 1982

[30] Foreign Application Priority Data

Mar. 20, 1981 [DE] Fed. Rep. of Germany ..... 3110854

[51] Int. Cl.[3] ..... F15B 9/10

[52] U.S. Cl. ..... 137/624.14; 137/624.18; 91/461; 91/170 MP; 91/517

[58] Field of Search ..... 91/170 MP, 529, 517, 91/518, 189 R; 405/302; 137/624.14, 624.18

[56] References Cited

U.S. PATENT DOCUMENTS

| | | | |
|---|---|---|---|
| 3,246,576 | 4/1966 | Kibble et al. | 91/189 R |
| 3,601,998 | 8/1971 | Bower | 405/302 |
| 3,821,880 | 7/1974 | Weirich et al. | 405/302 |
| 4,191,498 | 3/1980 | Weirich et al. | 405/302 |

*Primary Examiner*—Robert E. Garrett
*Assistant Examiner*—Randolph A. Smith
*Attorney, Agent, or Firm*—Berman, Aisenberg & Platt

[57] ABSTRACT

A control device for the sequential control of an advancing mine-roof support comprising pressure-controlled directional control valves alternately connectable to a high pressure line and to a return line in order to convert a pressure pulse into a switching step at the main control unit of the advancing mine-roof support and for transmitting an answering pressure pulse signalling the completion of the workstage for continuing the sequence.

4 Claims, 1 Drawing Figure

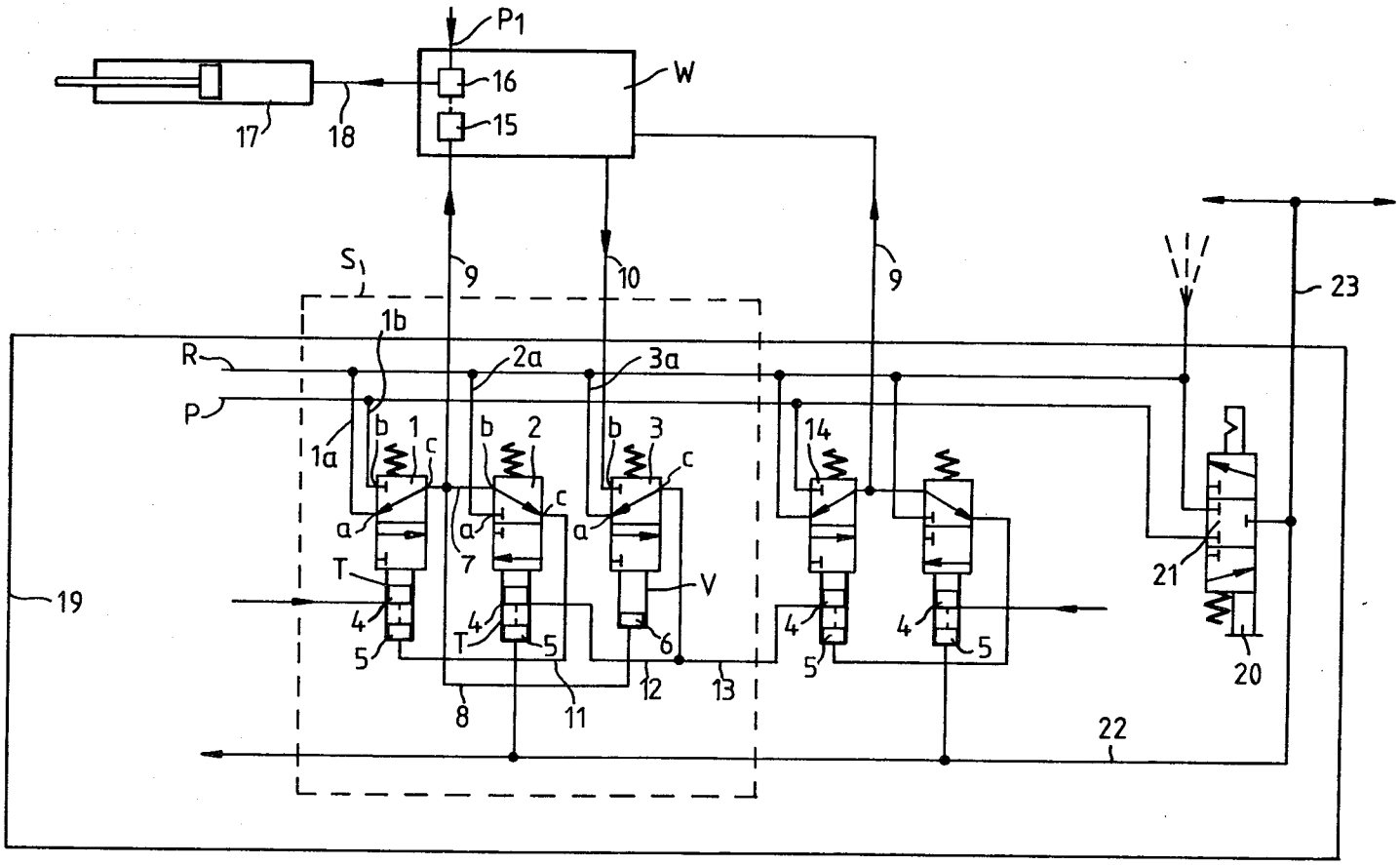
W
P1
16
15
18
17
9
10
9
S1
1b
1a
2a
3a
R
P
1
2
3
a
b
c
T
V
4
5
6
7
8
11
12
13
14
19
20
21
22
23

MINE-ROOF SUPPORT CONTROL MEANS

This invention relates to a control device for the sequential control of an advancing mine-roof support.

It is known to control the successive retraction, advancing and resetting workstages of an advancing mine-roof support using sequential switching. In one such control device—shown in German Specification No. 12 54 563—the switching sequence is actuated by a pressure pulse which is led via a flexible hose line from the adjacent mine-roof support to a control device in the support unit that is to be controlled. In the mine-roof support to be controlled, an operating piston is caused to be opened, and this leads to a splitting-up of the pressure pulse and to it pressurising and actuating a plurality of control valves simultaneously. On the way to the control device and in the control device itself, however, the pressure of the pulse diminishes due to the expansion of the hose line and to restrictions in the feed ducts of the control device. Since the pressure in the high pressure line is not constant but falls considerably during the carrying-out of workstages as a result of the abstraction of hydraulic liquid, a pressure pulse led to the control device may be attenuated so much that the control valves will no longer effect a connection and the swtiching sequence is interrupted. A renewed rise in the pressure in the high pressure line then causes the sequencing to be resumed at an unpredictable point in time. The consequences are not only waiting periods but also the possibility that advance of the mine-roof support will continue when the pressure again becomes effective. Frequent interruptions can appreciably delay the advancing of a group of supports, and there is also the danger that, when the switching sequence is again operative especially after prolonged stoppages, the supports will make uncontrolled movements which will injure workers in the mine and cause damage to the structure of the mine.

It is therefore a primary object of the present invention to construct a control device for an hydraulic sequential control system of mine-roof supports in such a way that the workstage actuated by a pressure pulse remains switched on reliably until the process is complete but is switched off below a predetermined level of pressure.

In one particular control device in accordance with the invention, a pressure pulse arriving at the control device opens a switching-on valve, and this leads to the actuating pulse being converted into a fresh switching pulse fed from the high-pressure line. This pulse acts on a switching valve in the main control unit which actuates the workstage. At the same time, pressure fluid flows through the opened switching-off valve of the control device to an actuating piston of the switching-on valve which then remains open until a switching-off valve in the control device moves to establish communication with a low-pressure return line. The switching-on valve is thus automatically held open by the pressurising of the said piston. The pressurised fluid from the swtiching-on valve also acts on an actuating piston of a transmission valve of the control device which is opened to transmit an answering pressure pulse signalling the completion of the workstage. This may be initiated, for example, by a limit switch on a movement-effecting cylinder of the mine-roof support. When the workstage has been carried out, the answering pulse acts on an actuating piston of the switching-off valve, which then opens to communicate with the return line. The result is that the pressure in the actuating piston of the switching-on valve is released and the automatic hydraulic hold is eliminated. At the same time the pressure in the actuating piston of the transmitting valve is also released, so that this valve also returns to the rest position in which it communicates with the return line.

The pressure pulse arriving, for example, from an adjacent mine-roof support thus opens a hydraulic switching circuit which obtains a supply of pressure fluid for itself from the high pressure line. This ensures that the triggered workstage is not only actuated but that pressure fluid is supplied from the high pressure line until the workstage has been completed. This event is signalled by the answering pulse which once more switches off the circuit to the return line. On the other hand, the actuated switching operation is switched off automatically only when the pressure in the high pressure line falls so much that the opened directional control valves switch off via the valve springs and are put into communication with the return line. The renewed build-up of pressure in the grid then does not reactivate the operational sequence, thus preventing an uncontrolled course of the workstages.

Alternatively, individual workstages can be actuated manually at the main control unit. However, because the switching-off valve is connected to the return line in the rest position, an answering pulse actuated at the main control unit by manual actuation is not transmitted, so that the sequential control mechanism cannot be actuated unintentionally. The course of the actuated switching sequence can at all times be interrupted by an emergency switching-off valve acting on actuating pistons of the switching-off valves. The switching-off valves, which are open in the rest position, then communicate with the return line, so that any switching operation is immediately interrupted.

A desired number of switching-off valves may be connected to an emergency switching-off valve which is present in every mine-roof support. For the sake of safety, the switching-off valves of both the actually concerned mine-roof support and also at least those of its right-hand and left-hand neighbours are connected to an emergency switching-off valve. A whole group of mine-roof supports to the left and right-hand sides may be included in this safety circuit.

An example of a control device in accordance with the invention is diagrammatically illustrated in the accompanying drawing which is a circuit diagram of the control device in respect of a particular workstage in combination with two valves of another control device and an emergency switching-off valve for switching off an actuated sequential control operation.

The illustrated control device is the boxed portion S of the circuit diagram which forms part of an overall control system for controlling the movements and operation of advancing mine-roof supports in mines. In particular, the control device S is adapted to control a specific workstage in the successive retraction, advancing and re-setting of mine-roof supports. Each control device actuates a single respective workstage only, so that a plurality of control devices can be arranged juxtaposed to one another in one control system in order to control all workstages of an advancing mine-roof support.

The control device S is connected to a high pressure line P carrying fluid under pressure and a return line R bleeding into the open in the case of pressurised air or into a reservoir in the case of hydraulic fluid. Three pressure-controlled and spring-loaded 3/2 directional control valves 1, 2 and 3 are provided in the control device for controlling a workstage, the said valves being a switching-on valve 1, a switching-off valve 2 and a transmitting valve 3. The switching-on valve 1 and the switching-off valve 2 are actuated by respective twin operating pistons 4 and 5, i.e., two mutually-superposed operating pistons 4 and 5, which move in respective cylinders T to cause the valves 1 and 2 to be brought into different positions when the cylinders T are pressurised. The transmitting valve 3 is caused to shift by a single operating piston 6 moving in a cylinder V.

The directional control valves 1, 2 and 3 each have three respective junctions a, b and c of which the junction a is in communication with the return line R through respective lines 1*a*, 2*a* and 3*a*. The switching-on valve 1 and the transmitting valve 3 are open to their respective junctions a (and hence communicate with the return line R) in their "rest" or inoperative positions, while the switching-off valve 2 is open to the return line R at its junction a in the operating position. The junction b of the switching-on valve 1 communicates with the high pressure line P through a line 1*b*.

The directional control valves 1, 2 and 3 are connected with one another in the following manner:

The junction c of the switching-on valve 1 is connected by a line 7 to the junction b of the switching-off valve 2, the line 7 being connected in turn to a line 8 leading to the cylinder V of the transmitting valve 3 and also to a line 9 which leads to a main control unit W in the mine-roof support that is to be controlled.

An answering pressure pulse from the main control unit W signalling the carrying-out of the workstages to be controlled is led to the junction b of the transmitting valve 3 via a line 10. The junction c of the valve 2 is connected to the second operating piston 5 of the switching-off valve 1 via the line 11. From the junction c of the transmitting valve 3, a branch line 12 leads to the first operating piston 4 of the switching-off valve 2 and a branch line 13 leads to the first operating piston 4 of a switching-off valve 14 of a further valve device connected in series which switches on the next-following workstage of the advancing mine-roof support.

Depending on the arrangement of the control device S within the overall control system, the first operating piston 4 of the switching-on valve 1 can thus be pressurised either by an answering pressure pulse from the mine-roof support or by a pressure pulse from the preceding workstage.

In the rest position the circuit formed by the directional control valves 1, 2 and 3 is in communication with the return line R, and the respective operating pistons 4, 5 and 6 have pressure on them released. If now the operating piston 4 of the switching-on valve 1 is acted on by a pressure pulse, the valve 1 shifts and connects the high pressure line P to junction c via junction b. The entering pressurised fluid then divides in three directions. Some of it flows to an operating piston 15 of the main control unit W via the line 9, with the said pressurised operating piston opening a switching valve 16 through which the pressure fluid is led to a working cylinder 17 carrying out the relevant workstage of the mine-roof support from a high pressure line $P_1$ along a short path via a pressure line 18 of large flow cross-section. To ensure that the switching valve 16 remains open until the workstage has been carried out, some of the pressurised fluid entering the switching-on valve 1 is led to the second operating piston 5 of the switching-on valve 1 through line 7, through the switching-off valve 2 which is in its rest or "open" position and thus open, and through the line 11. The switching-on valve 1 is now kept open by the self-generated flow of pressurised fluid. From the switching-on valve 1 another portion of the pressurised fluid reaches the operating piston 6 of the transmitting valve 3 via the line 8 and thus opens the valve 3.

After completion of the workstage, an answering pressure pulse passes through the line 10 from the main control unit W and is split up into the lines 12 and 13 by the opened transmitting valve 3. As a consequence, the first operating piston 4 of the switching-off valve 2 is pressurised and causes the valve to shift, so that the line 11 communicates with the return line R.

As the operating piston 5 of the switching-on valve 1 is now no longer pressurised, the switching-on valve 1 returns to its rest position and interrupts the supply of pressure from the high pressure line P. The line 9 ceases to be pressurised because it communicates with the return line R, so that the pressurised operating piston 15 in the main control unit W also assumes a position of rest and stops the supply of pressurised fluid to the connected working cylinder 17.

The answering pulse through the line 10 acts on the operating piston 5 of the valve 14 of the next-following control device via the line 13 and actuates the next workstage. Since the line 8 is no longer under pressure via the switching-on valve 1 communicating with the return line R, the opened transmitting valve 3 moves back into its rest position in which it communicates with the return line R. The circuit of the control device S is now again not under pressure.

To control all the workstages of an advancing mine-roof support it is desirable to have a plurality of the control device S described above, and these are accommodated in a valve housing 19 separately from the main control unit W. Because this valve housing 19 has comparatively small dimensions it is arranged as a preliminary control unit at a readily accessible place in the mine-roof support. If an unforseen event demanding an immediate interruption of the switching sequence were to occur after such a sequence has been actuated, then a switching lever 20 of an emergency switching-off valve 21 is operated by hand. In the operating position this leads pressure fluid from the high pressure line P through a line 22 to the second operating piston 5 of all switching-off valves 2 accommodated in the preliminary control unit. The operating step causes the switching-off valves 2 to communicate with the return line R, so that all circuits are switched off. From the emergency switching-off valve 21, a line 23 leads to the neighbouring mini-roof supports to the left and right, where the switching-off valves 2 are also moved to close the circuit. With sequential switching involving a whole group of mine-roof supports, the whole group can be connected to the emergency switching-off valve 21 in a corresponding manner. In that case the actuated switching sequence can be switched off by each preliminary control unit of the group.

The spring-loaded directional control valves 1, 2 and 3 are so adjusted that they remain in the open position only when the pressure fluid is at preset minimum pressure. If now the pressure falls below this value during a switching sequence, then the switching-off valve 2 returns to the rest position and the switching circuit is once more cut off from the pressure grid.

We claim:

1. Mine-roof support control means comrising:

(a) a main control unit incorporating a pressure-controlled valve;

(b) a workstage control device connected thereto and comprising a 3/2 switching-on valve, a 3/2 switching-off valve and a 3/2 transmitting valve, said 3/2 valves of the control device being alternately connectable to a high-pressure fluid line and to a low-pressure fluid return line in order to convert a pressure pulse into a switching step at the main control unit and for transmitting an answering pressure pulse signalling the completion of a workstage for continuing a sequence of operations;

(c) respective means for actuating the switching-on valve and the switching-off valve, said actuating means each including a fluid cylinder containing twin operating pistons;

(d) means for actuating the transmitting valve comprising a fluid cylinder containing one operating piston;

(e) fluid connections on said valves to provide for the return line to communicate with the switching-on valve and the transmitting valve in their inoperative positions and with the switching-off valve in its operating postion; and (f) fluid connections between the switching-on valve, the switching-off valve and the transmitting valve to ensure that, when a first one of the two actuating pistons of the switching-on valve is acted on by a pressure pulse, the switching-on valve communicates with the high pressure line and leads pressurised fluid to said pressure-controlled valve in the main control unit which actuates the workstage through the opened switching-off valve to the second actuating piston of the switching-on valve and to the actuating piston of the transmitting valve which opens to transmit the answering pressure pulse.

2. Control means according to claim 1, wherein a respective spring is provided on each of the three 3/2 valves of the control device whereby each valve is spring-loaded in the direction of its rest position in such a way that the valve remains in its operating position only while the pressure of the hydraulic pulses acting on its respective actuating piston is at a predetermined level.

3. Control means according to claim 1, wherein the actuating pistons of the switching-off valve of the control device are actuatable by an emergency switching valve under remote control.

4. Control means according to claim 1, wherein the three 3/2 valves of the control device are arranged to form a preliminary control unit which is spatially separate from the main control unit.

* * * * *